US009644839B2

(12) United States Patent
Yu

(10) Patent No.: US 9,644,839 B2
(45) Date of Patent: May 9, 2017

(54) DUAL VENTURI FOR WATER HEATER

(71) Applicant: KYUNGDONG NAVIEN CO., LTD., Pyeongtaek-si (KR)

(72) Inventor: Jeong Gi Yu, Gwangmyeong-si (KR)

(73) Assignee: KYUNGDONG NAVIEN CO., LTD., Pyeongtaek-si, Gyeonggi-Do (KR)

( * ) Notice: Subject to any disclaimer, the term of this patent is extended or adjusted under 35 U.S.C. 154(b) by 357 days.

(21) Appl. No.: 14/381,594

(22) PCT Filed: Jan. 22, 2013

(86) PCT No.: PCT/KR2013/000462

§ 371 (c)(1),
(2) Date: Aug. 27, 2014

(87) PCT Pub. No.: WO2013/129774

PCT Pub. Date: Sep. 6, 2013

(65) Prior Publication Data

US 2015/0064637 A1 Mar. 5, 2015

(30) Foreign Application Priority Data

Feb. 28, 2012 (KR) ..... 10-2012-0020641

(51) Int. Cl.
*B01F 5/04* (2006.01)
*F23D 14/04* (2006.01)
(Continued)

(52) U.S. Cl.
CPC ..... *F23D 14/04* (2013.01); *F23D 14/60* (2013.01); *F23D 14/62* (2013.01); *F23L 3/00* (2013.01);
(Continued)

(58) Field of Classification Search
CPC .... F23D 14/60; F23D 14/62; F23D 2203/007; F23D 2900/00003; F23D 14/04; Y10T 137/87587; B01F 5/0415
(Continued)

(56) References Cited

U.S. PATENT DOCUMENTS 2,105,056 A * 1/1938 Sartell ..... F02M 21/04 137/894
2,422,751 A * 6/1947 Schneider ..... F02M 1/00 261/41.2
(Continued)

FOREIGN PATENT DOCUMENTS

JP 2002-177751 A 6/2002
JP 2011-252666 A 12/2011
KR 10-0851635 B1 8/2008

OTHER PUBLICATIONS

International Search Report mailed Apr. 12, 2013 for International Application No. PCT/KR2013/000462.
(Continued)

*Primary Examiner* — Reinaldo Sanchez-Medina
(74) *Attorney, Agent, or Firm* — Novick, Kim & Lee, PLLC; Jae Youn Kim

(57) ABSTRACT

A dual venturi having a tubular part having primary and secondary passageways, wherein a primary gas inlet is provided on the side wall of the primary passageway; a body part, for opening/closing the flow of secondary air by rotating in horizontal plane and vertical plane directions, the horizontal plane direction being the cross-sectional direction of the tubular part and the vertical plane direction being perpendicular to the horizontal plane; a damper part having a damper part-side secondary gas outlet; a driving part, for rotationally driving the damper part in the horizontal and vertical planes; and a secondary gas inlet, which openly connects selectively to the damper part-side secondary gas
(Continued)

outlet on the basis of the rotational position of the damper part, and for forming the rotational shaft of the damper part along with the rotational shaft of the driving part.

10 Claims, 11 Drawing Sheets

(51) Int. Cl.

| | |
|---|---|
| ***F23N 3/06*** | (2006.01) |
| ***F23D 14/60*** | (2006.01) |
| ***F23D 14/62*** | (2006.01) |
| ***F23L 3/00*** | (2006.01) |
| *F24H 9/20* | (2006.01) |

(52) U.S. Cl.
CPC ..... *F23N 3/06* (2013.01); *F23D 2203/007* (2013.01); *F24H 9/2035* (2013.01)

(58) Field of Classification Search
USPC ..... 137/888, 891, 892, 893, 894, 895, 896, 137/897; 431/12, 354; 261/41.2, 41.3, 261/44.9

See application file for complete search history.

(56) References Cited

U.S. PATENT DOCUMENTS

| | | | | |
|---|---|---|---|---|
| 2,436,319 | A * | 2/1948 | Meyer | F02M 1/00 261/41.3 |
| 5,108,284 | A * | 4/1992 | Gruswitz | F23D 14/74 239/391 |
| 5,820,259 | A * | 10/1998 | Cummins | F28C 3/08 261/76 |
| 6,293,294 | B1 * | 9/2001 | Loeb | B01F 5/0405 137/1 |
| 6,604,938 | B1 | 8/2003 | Blaauwwiekel et al. | |
| 7,776,213 | B2 * | 8/2010 | Arnaud | B01D 21/2433 137/888 |
| 8,033,714 | B2 * | 10/2011 | Nishioka | B01D 53/8631 137/888 |
| 2001/0003291 | A1 * | 6/2001 | Uematsu | B01F 5/0451 137/888 |
| 2011/0139045 | A1 * | 6/2011 | Zatti | F23D 14/60 110/188 |
| 2013/0224670 | A1 * | 8/2013 | Zatti | F23D 14/02 431/38 |
| 2015/0050608 | A1 * | 2/2015 | Min | F23D 14/02 431/187 |
| 2015/0316254 | A1 * | 11/2015 | Kim | F23D 14/62 431/116 |

OTHER PUBLICATIONS

English Abstract for KR 10-0851635 B1.
English Abstract for JP 2002-177751 A.
English Abstract for JP 2011-252666 A.

* cited by examiner

DUAL VENTURI FOR WATER HEATER

TECHNICAL FIELD

The present invention relates to an air and gas mixing valve for a water heater, and particularly to an air and gas mixing valve for a water heater which controls the amount of gas and air supplied to the burner provided in a water heater for a more efficient control of the heat quantity.

BACKGROUND OF THE INVENTION

In general, a gas water heater system is a heating apparatus providing living convenience, such as providing hot water for washing or taking a shower by heating low temperature direct water, and is not used for heating purposes. The system consists of two methods: instantaneous gas water heater system and storage gas water heater system.

The instantaneous gas water heater system of the above methods uses instantaneous heat exchanger to instantly heat desired amount of direct water for tapping hot water, and the storage gas water heater system consists of storing hot water in a storage tank and storing it while maintaining at a constant temperature for supplying.

The two aforementioned gas water heater systems comprise a heating means for heating low temperature direct water, and the heating means supplies a gas mixture mixed in a mixing valve to a burner, the gas mixture consisting of gas that is supplied through a gas regulator and air supplied through a blower.

PRIOR ART

Patent Literature (Patent Literature 1) Korean Patent No. 10-113502

The aforementioned patent literature is directed to a composite gas water heater system manufactured by combining the instantaneous gas water heater and storage gas water heater, thus manufacturing a gas water heater of a compact volume while at the same time allowing a stable use thereof by decreasing temperature difference of the cold water and the hot water.

In the aforementioned patent literature, air and gas is supplied to the burner (28) by passing gas, supplied through a gas regulator (22) which controls the amount of gas, through a nozzle (26) to release heat to the upper portion, as shown in FIG. 6. At this time, the blower (24) supplies air to the burner (28), thereby increasing combustion rate of the gas.

However, aforesaid gas water heater system is simply a structure in which air and gas are mixed to be supplied to a burner. It does not include a function of controlling the amount of air and gas according to the amount of heat quantity of the burner used for heating hot water needed by the user. Thus, hot water heater needs to be manufactured according to the heat quantity, which increases the manufacturing cost.

DISCLOSURE OF INVENTION

Technical Problem

The present invention has been made to solve the above-described problem occurring in the prior art, and an object of the present invention is to provide a dual venturi with simplified structure to minimize the apparatus, high operational reliability, easy manufacturing process, and decreased manufacturing cost.

Another objective of the present invention is to provide a dual venturi which can independently control the ratio of the first-side and second-side air and gas.

Technical Solution

The first configuration of the present invention, for solving the above-described problem comprises, a tubular part, as a cylindrical duct, having primary and secondary passageways separated by an internal partition therebetween, in which a primary gas inlet is provided on the side wall of the primary passageway; a body part, located in the interior of the second passageway of the tubular part, for opening/closing the flow of secondary air by rotating in horizontal plane and vertical plane directions, the horizontal plane direction being the cross-sectional direction of the tubular part and the vertical plane direction being perpendicular to the horizontal plane; a damper part having a damper part-side secondary gas outlet; a driving part, connected to the lateral surface of the damper part via a rotational shaft, for rotationally driving the damper part in the horizontal and vertical planes; and a secondary gas inlet for introducing secondary gas into the secondary passageway of the tubular part via the damper part by means of the secondary gas inlet-side outlet, which connects selectively to the damper part-side secondary gas outlet on the basis of the rotational position of the damper part, and for forming the rotational shaft of the damper part along with the rotational shaft of the driving part.

Preferably, the driving part comprises a synchronous motor, and the rotational shaft of the driving part is the rotational shaft of the synchronous motor.

Preferably, the secondary gas inlet-side outlet is connected to the damper part-side secondary gas outlet when the body part of the damper part is vertically positioned.

Preferably, the driving part includes a limit switch for indicating the horizontal and vertical direction positions of the damper part.

Preferably, the central diameter width of the tubular part increases from the center towards the upper and lower portions.

Preferably, the damper part-side secondary gas outlet is formed on the outer surface such that it is facing the upper side of the tubular part when the body part is positioned in the horizontal direction.

Preferably, the damper part-side secondary gas outlet is formed on the outer surface such that it is facing both the upper side and the lower side of the tubular part when the body part is positioned in the horizontal direction.

Preferably, only one secondary gas inlet-side outlet is formed, which is connected to the damper part-side secondary gas outlet when the damper part is vertically positioned.

Preferably, two secondary gas inlet-side outlets are formed, which are connected to the damper part-side secondary gas outlet when the damper part is vertically positioned.

Advantageous Effects

The following advantageous effects can be obtained through the present invention having the above configurations.

First, the inner portion of the tubular part is partitioned to form a primary passageway and secondary passageway. The air ratio of the first-side flow and second-side flow can be easily regulated since only the primary air and primary gas flow through the primary passageway and only the secondary air and secondary gas flow through the secondary passageway.

Second, opening on one-side of the secondary gas inlet is set as the secondary gas outlet, such that the secondary gas outlet is opened/closed simultaneously with opening/closing to the secondary air passageway via the rotation of the damper part. Thus, the structure is very simplified.

Third, the motor rotational shaft and the cylindrical gas inlet is used as the rotational shaft of the damper part, thus it is not necessary to install a separate rotational shaft. Further, the rotation of the damper part opens/closes the outlet of the stopped secondary gas inlet, thereby increasing operational reliability in addition to the simple structure thereof.

Fourth, generally a widely used ventilation facilities can be used for the damper part, allowing simple manufacturing process. Further, a synchronous motor can be used to directly connect the damper part to the rotational shaft of the motor of the driving part, thus additional elements such as a wire or a spring are not required, resulting in more simplified structure, and the overall volume is decreased.

Fifth, based on the first to fourth reasons above, simplification of the structure and decreased manufacturing costs can be achieved.

BRIEF DESCRIPTION OF THE DRAWINGS

FIG. 3*a* is a perspective view of the dual venturi, FIG. 3*b* is a planar sectional view of the dual venturi and FIG. 3*c* is a sectional view showing the positional relationship between the secondary gas inlet and the secondary gas outlets of the damper part.

FIG. 4*a* is a planar sectional view of the dual venturi and FIG. 4*b* is a sectional view showing the positional relationship between the secondary gas inlet and the secondary gas outlets of the damper part.

FIG. 5*a* is a planar view of the limit switch and FIG. 5*b* is a lateral view of the limit switch.

DESCRIPTION OF THE PREFERRED EMBODIMENTS

Hereinafter, the first embodiment of the present invention will be described with reference to the accompanying drawings.

Figure 1:
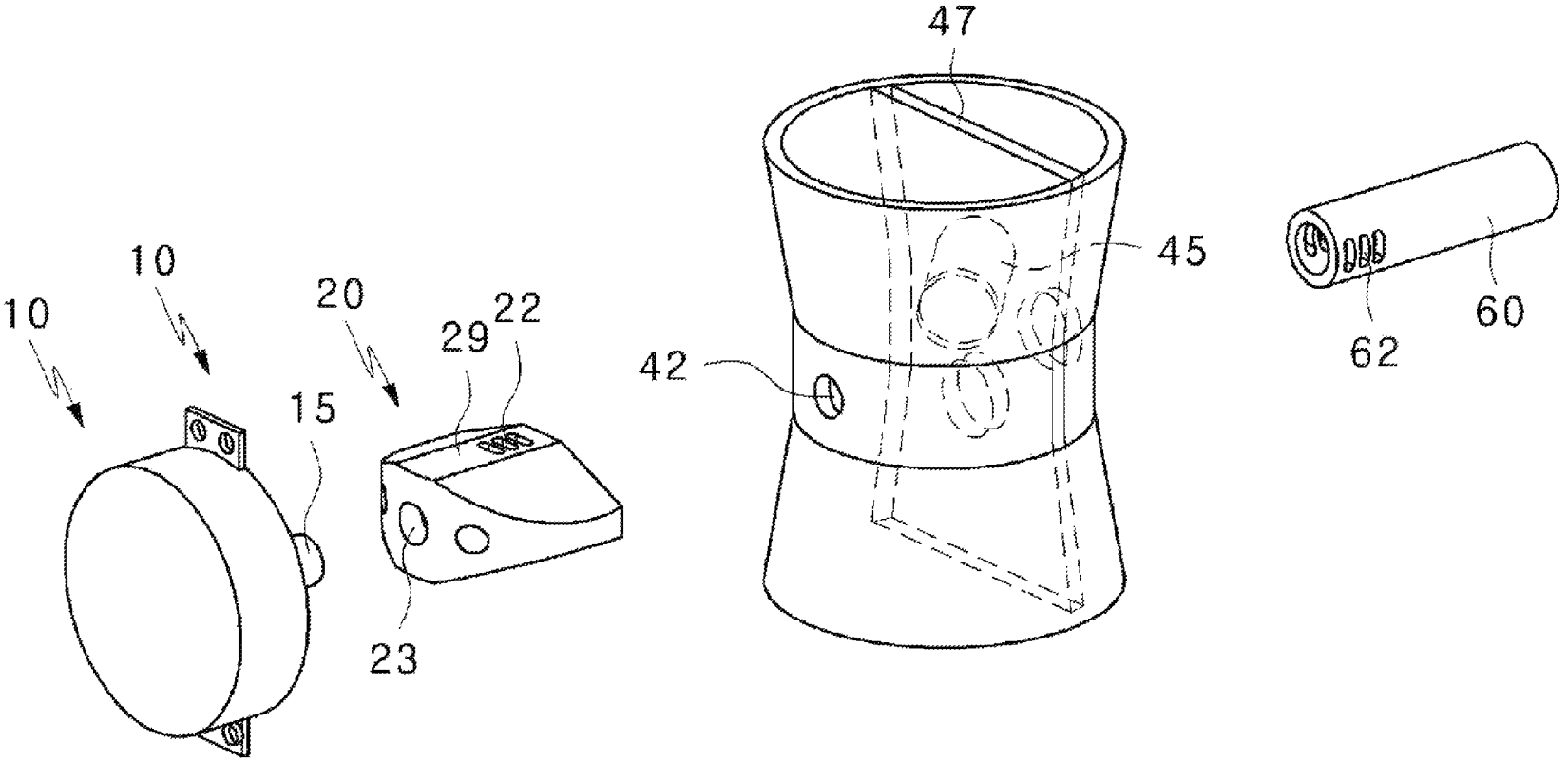
FIG. 1 is an exploded perspective view showing the dual venturi according to the first embodiment of the present invention.
Figure 2A:
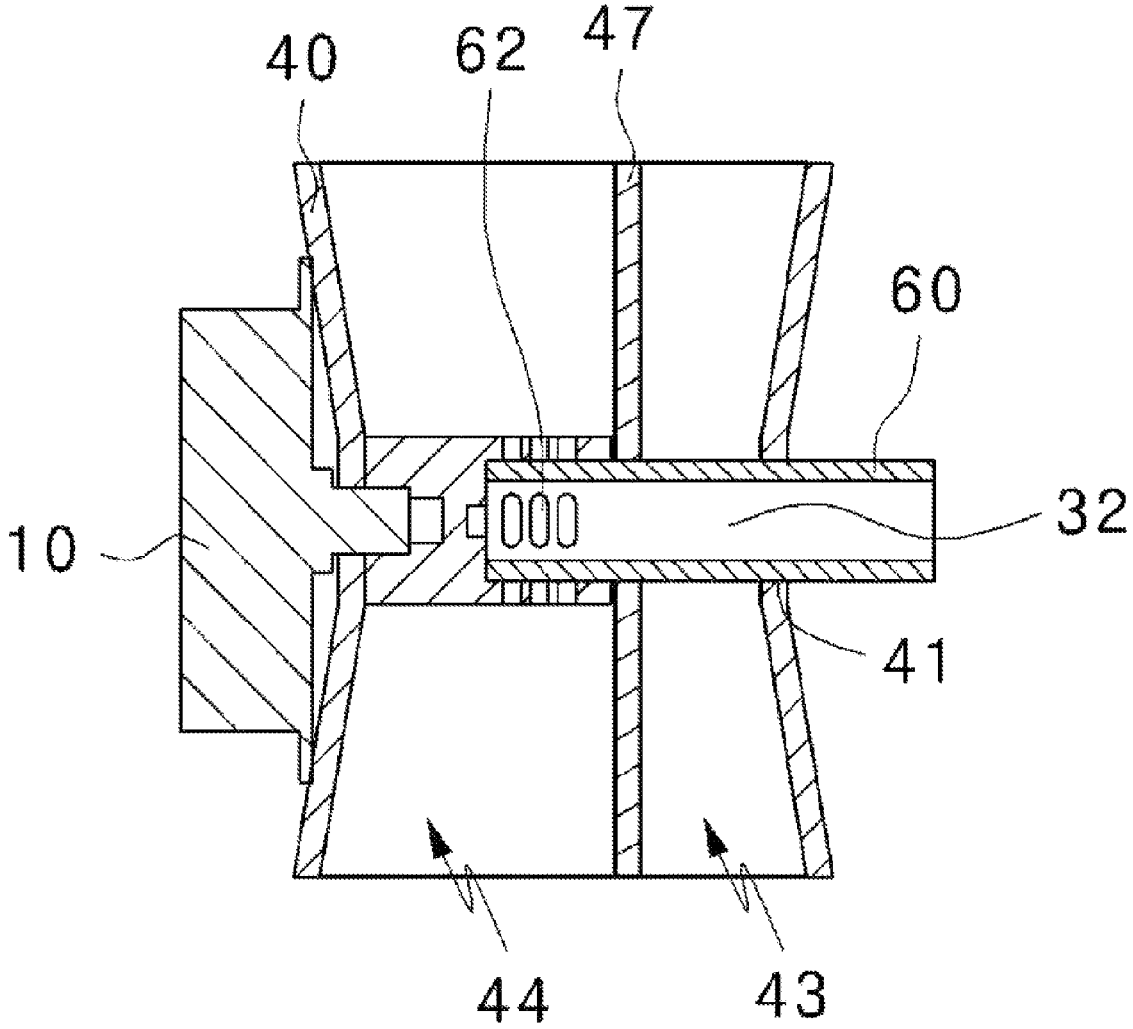
FIG. 2*a* shows an embodiment of the present invention, that is a longitudinal sectional view of the dual venturi with the damper part in a closed state.
Figure 2B:
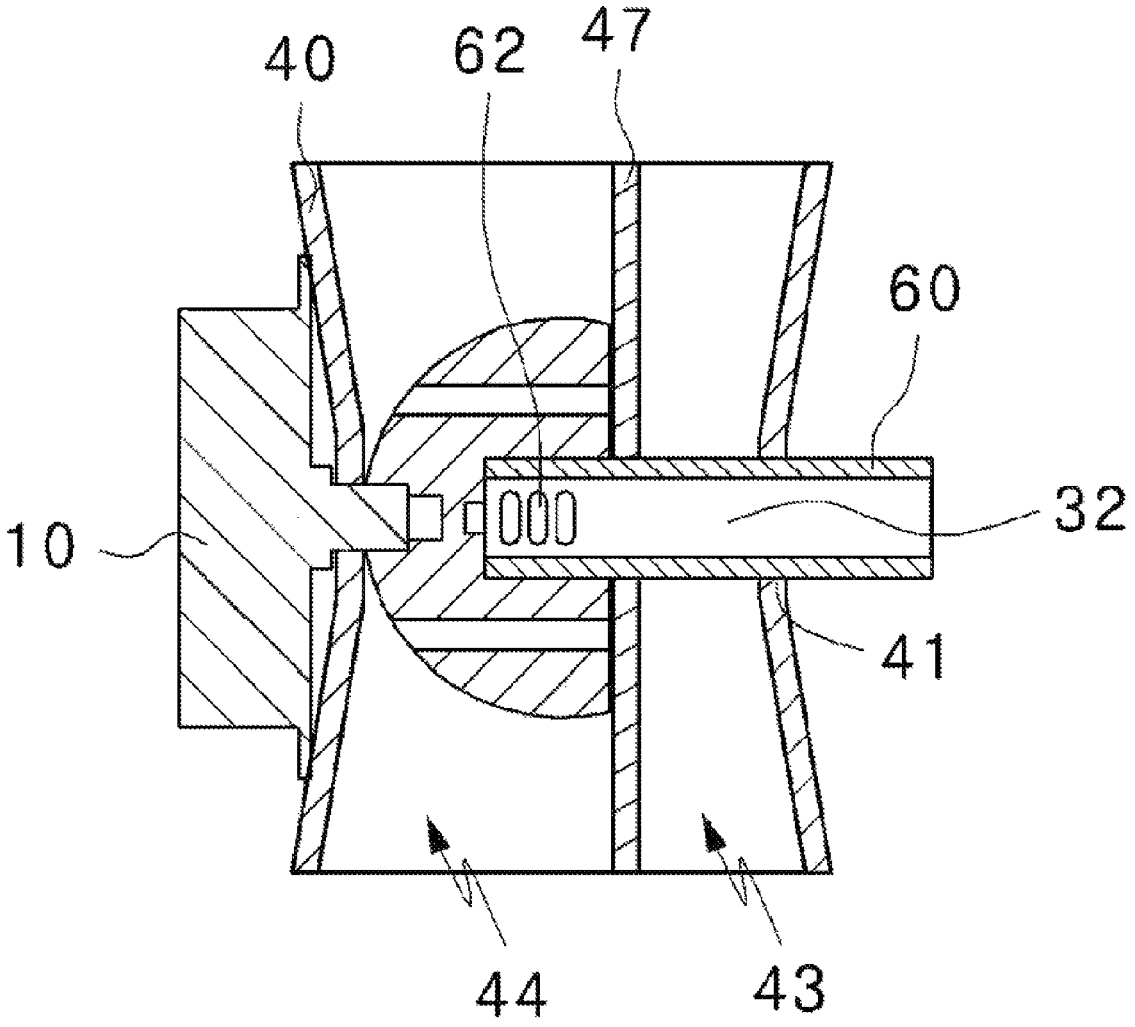
FIG. 2*b* is a longitudinal sectional view showing the dual venturi with the damper part in an open state.

First, the overall structure of the dual venturi is explained with reference to FIG. 1, FIG. 2*a* and FIG. 2*b*. FIG. 1 is an exploded perspective view defining the dual venturi according to an embodiment of the present invention, FIG. 2*a* shows an embodiment of the present invention, that is a longitudinal sectional view of the dual venturi with the damper in a closed state, and FIG. 2*b* is a longitudinal sectional view showing the dual venturi with the damper in an open state, respectively.

The dual venturi according to the present invention comprises a tubular part (40) having a primary passageway (43) and a secondary passageway (44) separated by a partition (47) therebetween (Refer to FIGS. 2*a* and 2*b*), with a primary gas inlet (45) provided on the center of the side wall of the primary passageway (43); a damper part (20) formed on the tubular part (40) for opening/closing the secondary passageway (44) which forms the secondary air passageway extending in the direction from the lower portion to the upper portion of the tubular part (40); a driving part (10) connected to the lateral surface of the damper part (40) and inserted via the tubular part side second hole (42), resulting in the rotational shaft (15) of the motor to be connected to the damper part-side first hole (23) to rotationally drive the damper part (20); and a secondary gas inlet (60) inserted through the first hole (41) of the tubular part (40), and then passing through the primary passageway (43) and the partition (47) to connect to the damper part-side second hole (27) (Refer to FIG. 3*c*) within the secondary passageway (44), thereby supplying secondary gas via the damper part (20). In this manner, the tubular part (40) allows only the primary air and primary gas to pass through the primary passageway (43) separated by the partition (47), and allows only the secondary air and secondary gas to pass through the secondary passageway (44), to effectively regulate the air-gas ratio of the primary mixed airflow and secondary mixed airflow.

As illustrated in FIG. 1, the tubular part (40) has a central diameter that is smaller than the diameter of both ends of the higher and lower portions, thus the central passageway is narrowly formed. This configuration can be more clearly understood from FIG. 2*a* and FIG. 2*b*. However, the shape of the tubular part (40) can be a cylindrical shape with equal upper and lower portions, and the present invention is not particularly limited to this shape.

The damper part (20) comprises an overall semicircle shaped body part (29), which has a horizontal area that can block the secondary passageway (44) of the tubular part (40), the upper surface of the body part (29) being provided with a damper part-side secondary gas outlet (22) having four slot-type holes through which secondary gas is discharged. The body part (29) corresponding thereto can also have a secondary gas outlet. That is, it can also be formed on the corresponding lower portion of the secondary gas outlet (22). Further, four slot-type holes are shown, but the number of the slot-type holes can be suitably selected according to need, and its shape can also be varied.

As shown in FIG. 2*a* and FIG. 2*b*, end part of the secondary gas inlet (60) in contact with the damper side (20) is closed by the damper part.

The secondary gas inlet (60) is cylindrically shaped, and is connected to the damper part-side second hole (27) (Refer to FIG. 3*c*) within the second passageway (44) via insertion through the tubular part-side first hole (41), the primary passageway (43) and the partition (47). Here, the secondary gas inlet (60) does not rotate but the damper part (20) can, thus the secondary gas inlet (60) also functions as a stationary shaft to rotate the damper part (20) together with the rotational shaft (15) of the motor. The damper part-side portion of the secondary gas inlet (60) becomes a closed state as defined above, and a secondary gas inlet-side secondary gas outlet (62) having an identical shape to the damper part-side secondary gas outlet (22) is formed on the circumference of the area near the damper part-side of the secondary gas inlet (60). The secondary gas inlet-side secondary gas outlet (62) is also symmetrically shaped and can form outlets on both sides of the pipe or form an outlet only on one side. FIG. 2*a* illustrates a closed state of the damper part (20), that is the state in which the upper and lower passageways of the secondary passageway (44) of the tubular part (40) are blocked and only the primary passageway (43) of the damper part (20) is used as the passageway for the primary air and primary gas of the tubular part (40) to pass through. In other words, the state in which the damper part (20) is placed in the cross-sectional direction, that is the horizontal plane of the tubular part (40), only the primary gas inlet (45) is open towards primary passageway of the tubular part (40) (maintains an open state at all times), and the secondary gas inlet-side secondary gas outlet (62) is closed.

FIG. 2*b* illustrates opened state of the damper part (20), that is the state in which the upper and lower passageways of the tubular part (40) are open, thus most of the primary passageway (43) as well as the secondary passageway (44) of the tubular part (40) is substantially used as the air passageway, the so-called secondary air passing state. Here, the damper part (20) is placed in the vertical plane that is perpendicular to the horizontal plane, and the primary gas inlet (45) as well as the secondary gas inlet-side secondary gas outlet (62) are both open towards the damper part-side secondary gas outlet (22). As a result, all functions of the first step distribution and second step distribution can be executed.

Hereafter, operation of the dual venturi according to an embodiment of the present invention will be described in detail with reference to FIG. 3*a* to FIG. 5*b*. Parts not thoroughly explained in the above detailed description will be explained through the additional configuration.

Figure 3A:
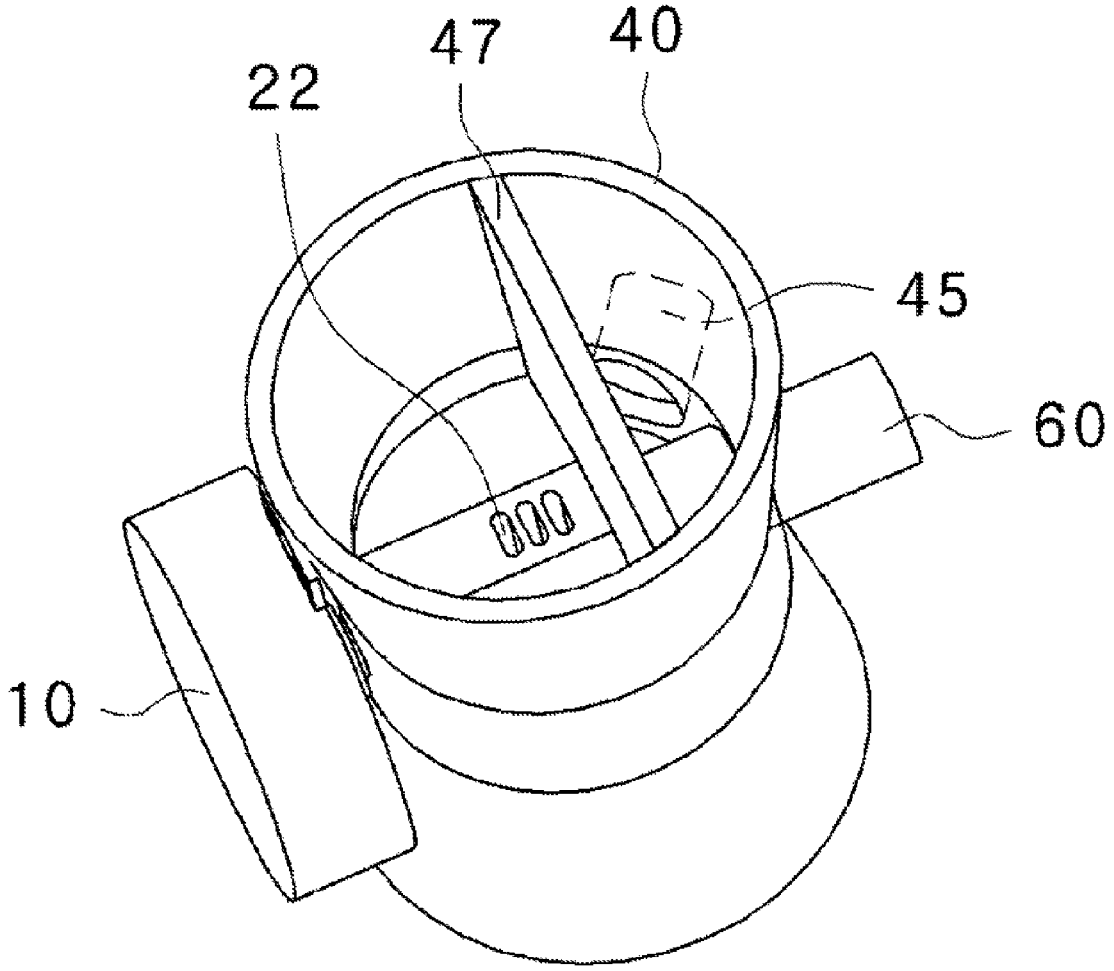
FIG. 3*a*, FIG. 3*b* and FIG. 3*c* show an embodiment of the present invention, that is a diagram showing the damper part in the closed state.
Figure 3B:
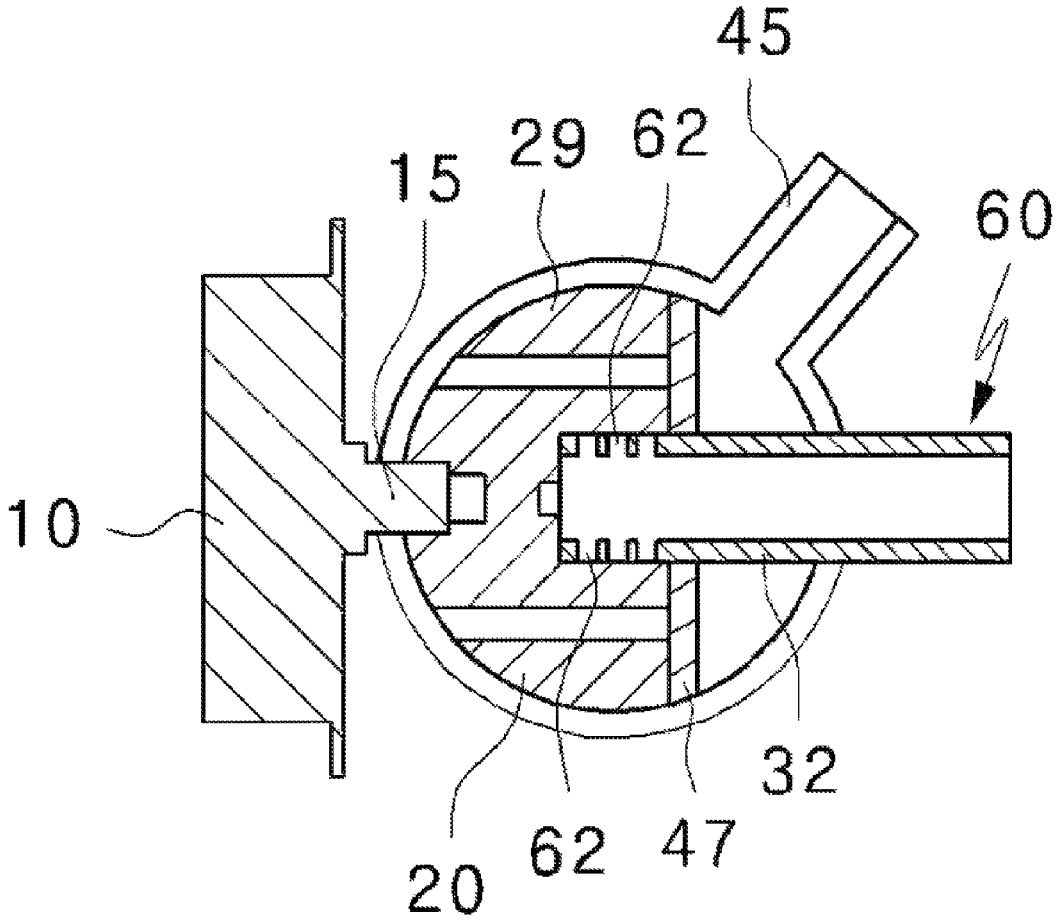
Figure 3C:
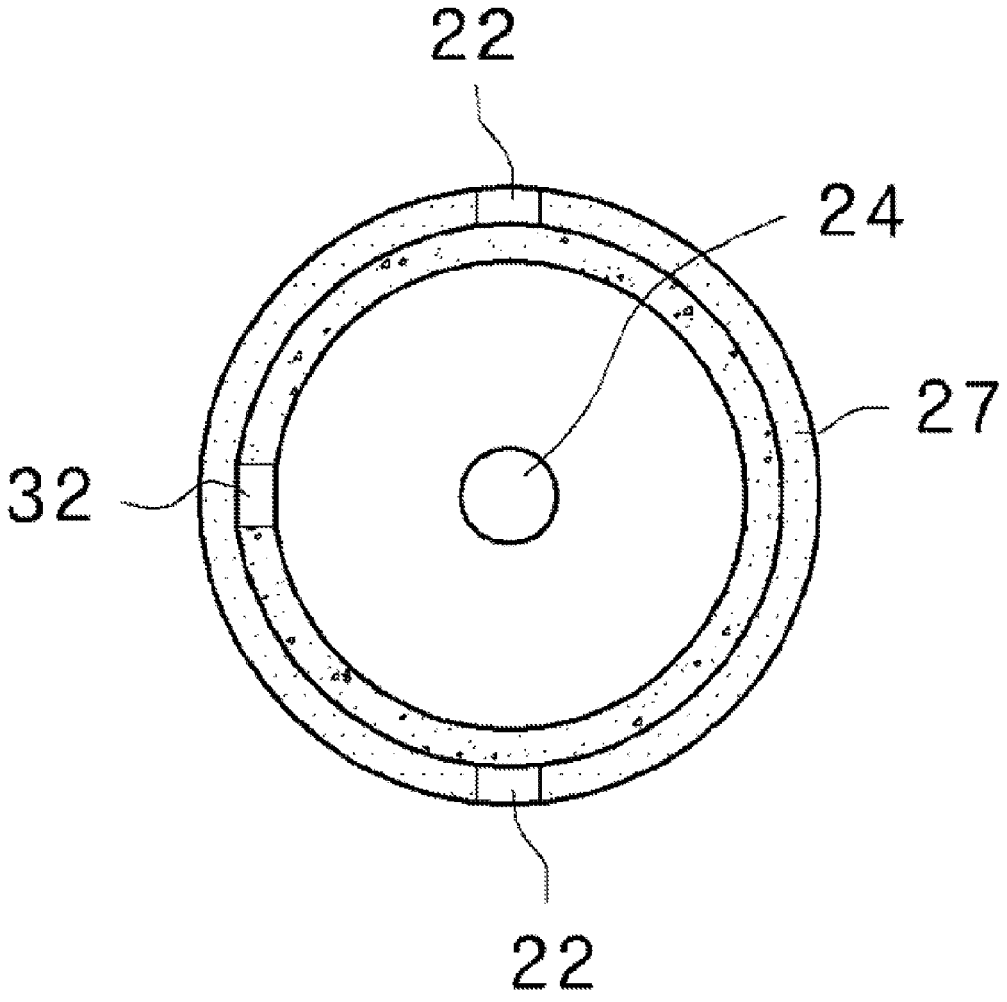

First, FIG. 3*a*, FIG. 3*b* and FIG. 3*c* show an embodiment of the present invention, that is a diagram showing the closed state of the damper part (20). FIG. 3*a* is a perspective view of the dual venturi, FIG. 3*b* is a planar sectional view of the dual venturi and FIG. 3*c* is a sectional view showing the positional relationship between the secondary gas inlet and the secondary gas outlets of the damper part.

As shown in the perspective view of FIG. 3*a*, when the damper part (20) is closed, the positional relationship between the tubular part (40) and the damper part (20) is equal to when the damper part (20) blocks the entire upper and lower air passageways of the secondary passageway (44) of the tubular part (40), and only the primary passageway (43) substantially becomes the air passageway (primary air passageway) of the tubular part (40). In other words, the damper part (20) is placed in the horizontal plane in the cross-sectional direction of the tubular part (40), and at this time, as shown in FIG. 3*b*, only the primary gas inlet (45) is open towards the tubular part (40) side (open at all times) so that primary gas flows through the tubular part (40), and the secondary gas inlet-side secondary gas outlet (62) is blocked by the wall of the damper part-side second hole (27) and thus closed, as shown in FIG. 3*c*. That is, a small quantity of relatively low level primary air and primary gas flow through the primary passageway (43) of the tubular part in the closed state.

Figure 4A:
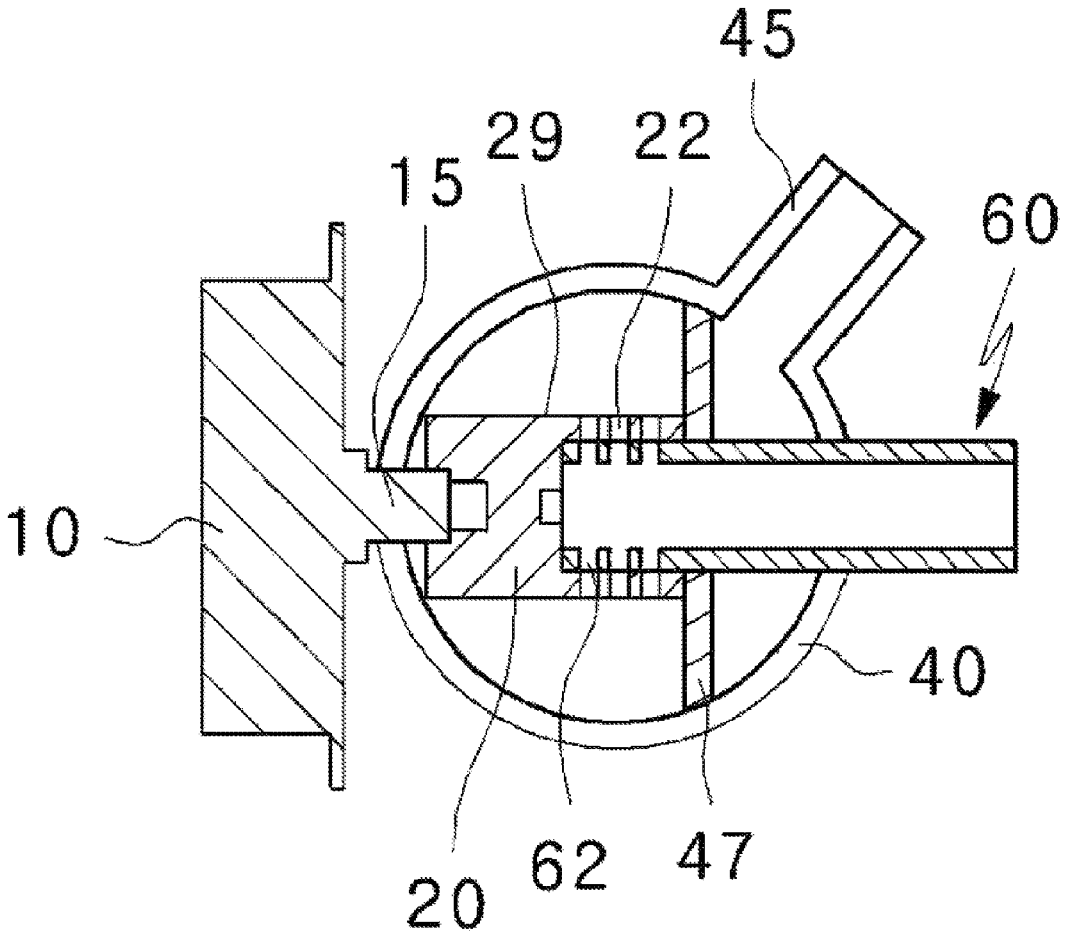
FIG. 4*a* and FIG. 4*b* show an embodiment of the present invention, that is a diagram showing the damper in the open state.
Figure 4B:
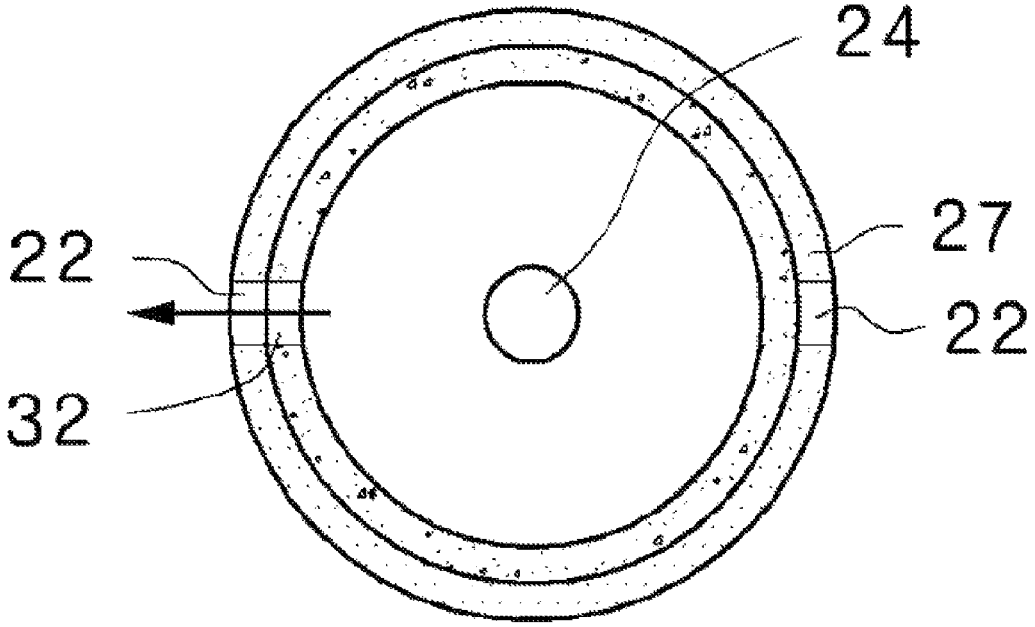

FIG. 4*a* and FIG. 4*b* show an embodiment of the present invention, that is a diagram showing the open state of the damper part. FIG. 4*a* is a planar sectional view of the dual venturi and FIG. 4*b* is a sectional view showing the positional relationship between the secondary gas inlet and the secondary gas outlets of the damper part.

As shown by the sectional view of FIG. 4*a*, when the damper part (20) is opened, the positional relationship between the tubular part (40) and the damper part (20) is equal to the substantially opened state of the entire upper and lower air passageways of the tubular part (40) via the opening of the secondary passageway (44). In other words, the damper part (20) is placed upright in the vertical direction to the horizontal plane in the closed state, that is the vertical plane to the cross-sectional direction of the secondary passageway (44) of the tubular part (40). At this time, as shown in FIG. 4*a*, the primary gas flows through the primary gas inlet (45) and also the secondary gas inlet-side secondary gas outlet (62) is opened to let the secondary gas flow out of the secondary passageway (44).

Referring to FIG. 4*b*, the secondary gas inlet-side secondary gas outlet (62) and the damper part-side secondary gas outlet (22) formed on the wall of the damper part-side second hole (27) correspond to each other and thereby are connected.

In this embodiment, the secondary gas inlet-side secondary gas outlet (62) is formed only on one part of the circumference diameter such that only one lateral surface (for instance, the upper direction-side surface of the upper and lower directions of the tubular part (40)) of the damper part (20) releases secondary gas. However, for instance, the secondary gas inlet-side secondary gas outlet (62) can be installed on the opposite side (that is, 180°) of the cylindrical secondary gas inlet (60) wall circumference to release secondary gas in the upper and lower directions of the damper part (20).

Figure 5A:
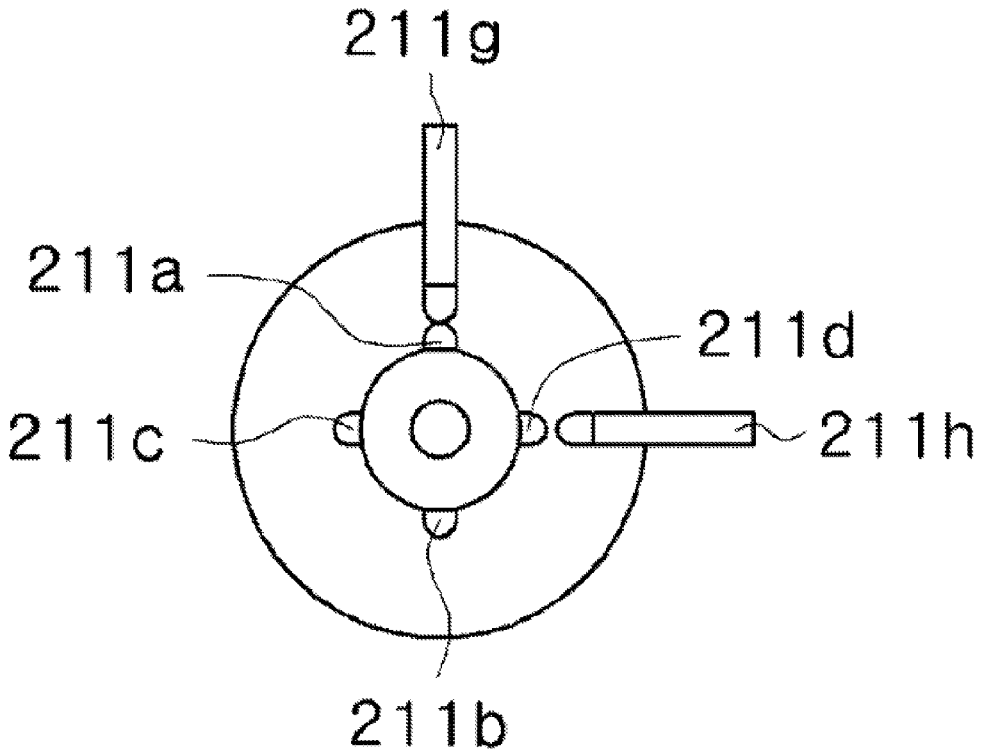
FIG. 5*a* and FIG. 5*b* show the positional relationship between secondary gas inlet-side secondary gas outlet and the damper part at the limit switch of the driving part.
Figure 5B:
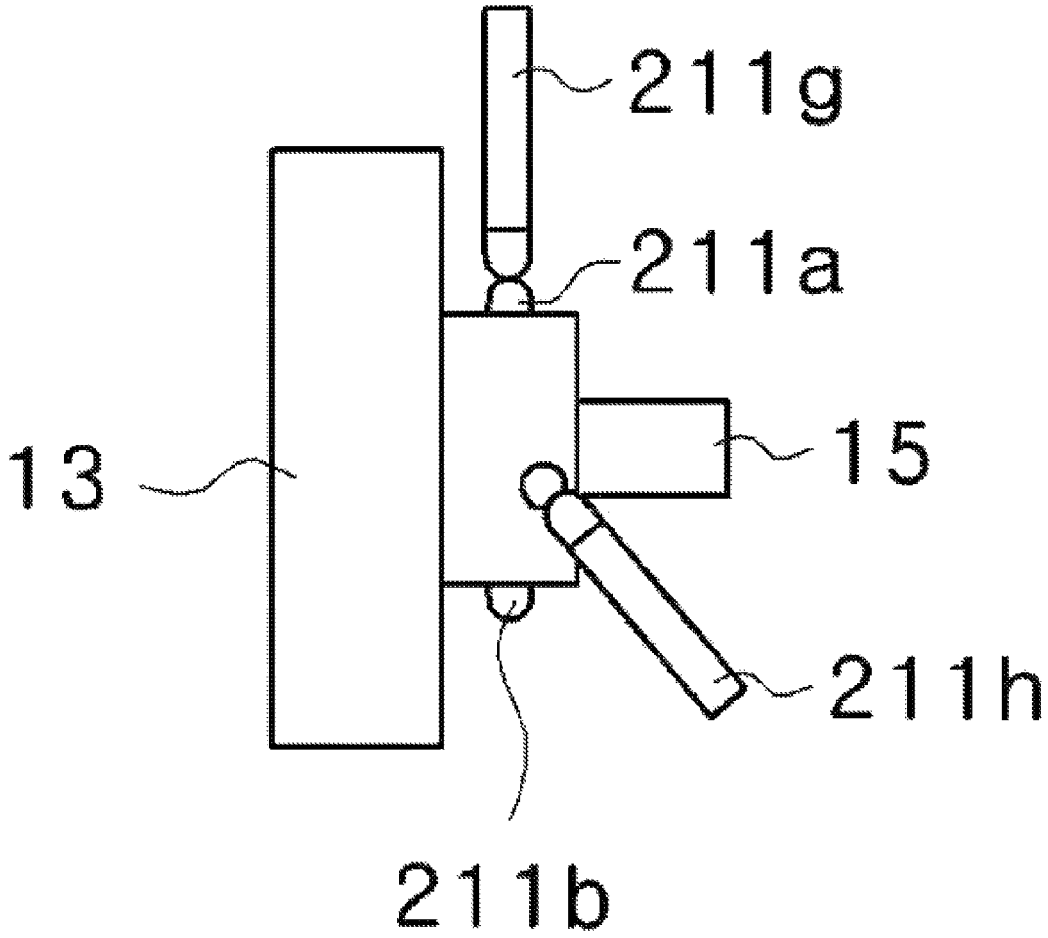
Figure 6:
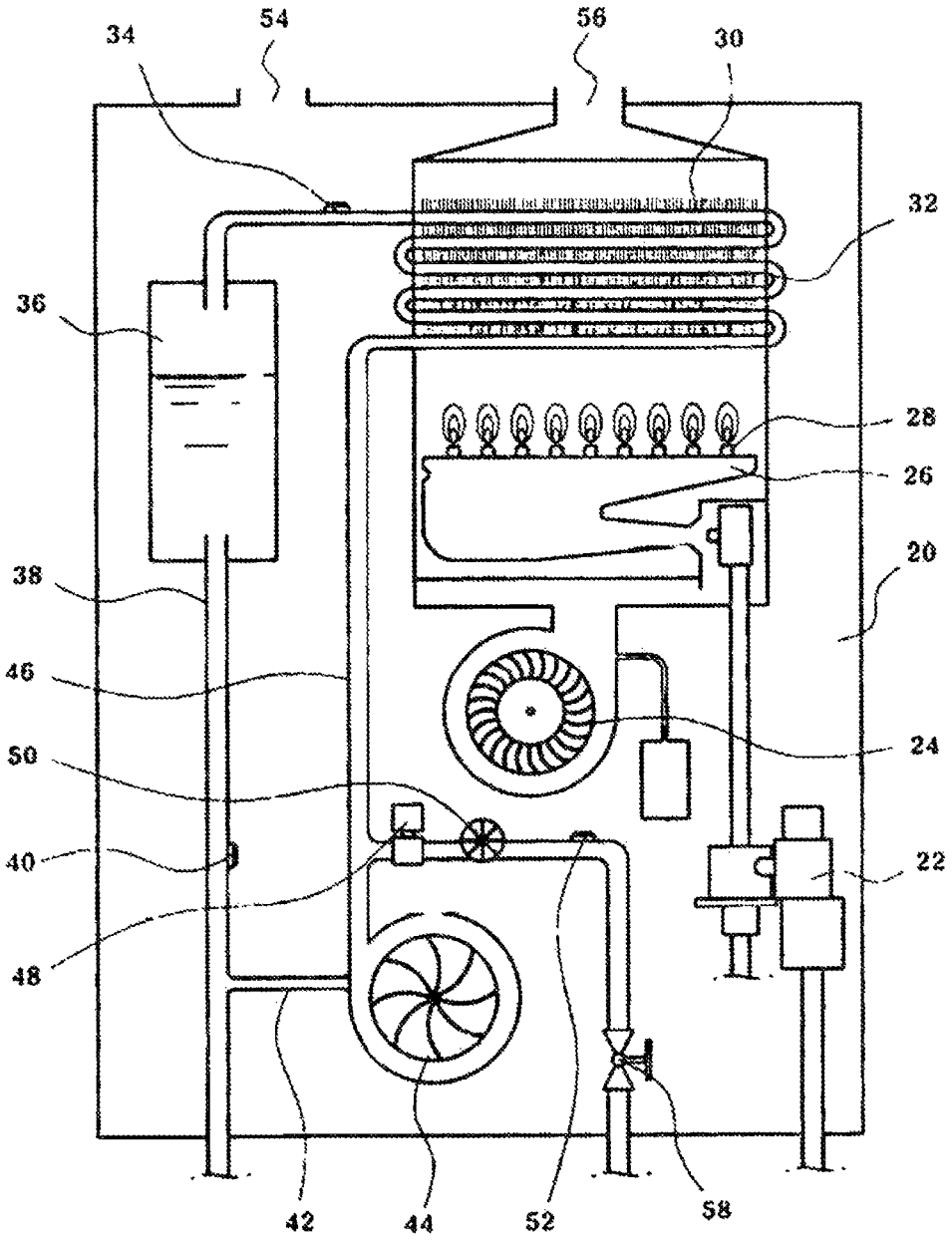
Figure 6 PRIOR ART
FIG. 6 is a drawing showing prior art.

FIG. 5*a* and FIG. 5*b* show the positional relationship between the secondary gas outlet of the secondary gas inlet and the damper part at the limit switch of the driving part. FIG. 5*a* is a planar view of the limit switch and FIG. 5*b* is a lateral view of the limit switch, respectively.

In the limit switch (11) shown in FIG. 5*a*, reference signs 211*a* and 211*b* show the position points of the damper part-side secondary gas outlets, 211*c* and 211*d* respectively show the position points of the secondary gas inlet-side secondary gas outlets, 211*g* shows the damper part-side positional probe, and 211*h* shows the secondary gas inlet-side positional probe, respectively. One of the damper part-side secondary gas outlet position points (211*a*)(211*b*) is positioned at the damper part-side positional probe (211*g*), and in the same manner if one of the secondary gas inlet-side secondary gas outlet position points (211*c*)(211*d*) corresponds to the secondary gas inlet-side positional probe (211*h*), secondary air and secondary gas are blocked, as shown in FIG. 3*c*. That is, it shows the state in which the damper part (20) is at the horizontal position.

Further, on the contrary, if one of the secondary gas inlet-side secondary gas outlet position points (211*c*)(211*d*) corresponds to the damper part-side positional probe (211*g*), and at the same time one of the damper part-side secondary gas outlet position points (211*a*)(211*b*) is positioned at the secondary gas inlet-side positional probe (211*h*), the secondary air and secondary gas are open to flow through the tubular part (40), as shown in FIG. 4*a*. That is, this shows the state in which the damper part (20) is vertically positioned.

Referring to FIG. 5*b*, a synchronous motor is used as the motor (13) included in the driving part (10) and the rotational shaft (15) of the direct motor (13) can be connected to the damper part-side first hole (23). Thus, components necessary for the AC motor in the prior art such as a wire, or return spring can be removed, allowing the dual venturi of the present invention to be more simplified compared to the prior art.

The above description defines a preferred embodiment of the present invention but is not limited thereto, and various modifications and other similar embodiments are possible by the skilled person in the art. For instance, the combination of the limit switch sets the secondary gas open state as when the damper part-side probe and the secondary gas inlet-side probe positions are against each secondary gas outlet positions. However, the opposite setting may be used as long as practically identical results are obtained. Further, positions of the primary gas inlet and the partition of the tubular part may be varied according to their use, to change the flow velocity of the primary passageway and the secondary passageway. Thus, various modifications and embodiments that can be clearly expected are also within the scope of the present invention.

REFERENCE SIGNS

10: Driving Part, 11: Limit Switch, 15: Rotational Shaft of the Motor, 20: Damper Part,
22: Damper Part-Side Secondary Gas Outlet, 23: Damper Part-Side First Hole,
24: Damper Part-Side Sealing Hole, 27: Damper Part-Side Second Hole, 29: Body Part,
40: Tubular Part, 41: Tubular Part-Side First Hole, 42: Tubular Part-Side Second Hole,
43: Primary Passageway, 44: Secondary Passageway, 45: Primary Gas Inlet, 47: Partition,
60: Secondary Gas Inlet, 62: Secondary Gas Inlet-Side Outlet,
211*a*: Damper Part-Side Secondary Gas Outlet Position Point
211*b*: Damper Part-Side Secondary Gas Outlet Position Point,
211*e*: Secondary Gas Inlet-Side Outlet Position Point,
211*d*: Secondary Gas Inlet-Side Outlet Position Point, 211*g*: Damper Part-Side Positional Probe,
211*h*: Secondary Gas Inlet-Side Positional Probe

The invention claimed is:

1. A dual venturi comprising, a tubular part having a primary passageway and a secondary passageway separated by an internal partition therebetween, wherein a primary gas inlet is provided on a side wall of the primary passageway;

a damper part having a damper part-side secondary gas outlet and a body part, the damper part being located in an interior of the second passageway of the tubular part, for opening/closing a flow of a secondary air by rotating in a horizontal plane and a vertical plane directions, the horizontal plane direction being a cross-sectional direction of the tubular part and the vertical plane direction being perpendicular to the horizontal plane;

a driving part, connected to a lateral surface of the damper part via a rotational shaft, for rotationally driving the damper part in the horizontal and vertical plane directions; and a secondary gas inlet for introducing a secondary gas into the secondary passageway of the tubular part via the damper part by means of a secondary gas inlet-side outlet, which connects selectively to the damper part-side secondary gas outlet according to a rotational position of the damper part, wherein the secondary gas inlet is coupled with the damper part such that the secondary gas inlet is configured to function as a stationary rotational shaft for fixing the damper part and the damper part can be rotated on the secondary gas inlet when the damper part is rotated by the rotational shaft of the driving part.

2. The dual venturi as claimed in claim 1, wherein the driving part comprises a synchronous motor connected to the rotational shaft of the driving part.

3. The dual venturi as claimed in claim 2, wherein the secondary gas inlet-side outlet is connected to the damper part-side secondary gas outlet when the body part of the damper part is vertically positioned.

4. The dual venturi as claimed in claim 2, wherein the driving part comprises a limit switch indicating a vertical position and a horizontal position of the damper part.

5. The dual venturi as claimed in claim 2, wherein a diameter width of the tubular part increases from a center towards an upper portion and a lower portion thereof.

6. The dual venturi as claimed in claim 1, wherein the damper part-side secondary gas outlet is formed on an upper or a lower outer surface of the body part, when the damper part is positioned in the horizontal plane direction.

7. The dual venturi as claimed in claim 6, wherein the secondary gas inlet-side outlet is formed on a left or a right side surface of the secondary gas inlet and configured to be connected to the damper part-side secondary gas outlet formed on the upper or the lower outer surface of the body part when the damper part is vertically positioned.

8. The dual venturi as claimed in claim 1, wherein the secondary gas inlet-side outlet is connected to the damper part-side secondary gas outlet when the body part of the damper part is vertically positioned.

9. The dual venturi as claimed in claim 1, wherein the driving part comprises a limit switch indicating a vertical position and a horizontal position of the damper part.

10. The dual venturi as claimed in claim 1, wherein a diameter width of the tubular part increases from a center towards an upper portion and a lower portion thereof.

* * * * *